US005089047A

United States Patent [19]

Buljan et al.

[11] Patent Number: 5,089,047

[45] Date of Patent: * Feb. 18, 1992

[54] CERAMIC-METAL ARTICLES AND METHODS OF MANUFACTURE

[75] Inventors: Sergej T. Buljan, Acton; Helmut Lingertat, Dorchester; Steven F. Wayne, Scituate, all of Mass.

[73] Assignee: GTE Laboratories Incorporated, Waltham, Mass.

[ * ] Notice: The portion of the term of this patent subsequent to Oct. 1, 2008 has been disclaimed.

[21] Appl. No.: 632,238

[22] Filed: Dec. 20, 1990

Related U.S. Application Data

[63] Continuation-in-part of Ser. No. 576,241, Aug. 31, 1990, abandoned.

[51] Int. Cl.[5] ..... C22C 29/02

[52] U.S. Cl. ..... 75/236; 75/237; 75/238; 75/239; 75/240; 75/241; 75/242; 75/244; 428/547; 428/610

[58] Field of Search ..... 75/236, 237, 238, 239, 75/240, 241, 242, 244; 428/547, 610

[56] References Cited

U.S. PATENT DOCUMENTS

| | | | |
|---|---|---|---|
| 3,653,882 | 4/1972 | Petrasek et al. | 419/49 |
| 3,696,486 | 10/1972 | Benjamin | 75/206 |
| 4,173,685 | 11/1979 | Weatherly | 75/238 |
| 4,507,263 | 3/1985 | Ron | 419/49 |
| 4,615,735 | 10/1986 | Ping | 419/49 |
| 4,650,519 | 3/1987 | Chang et al. | 75/244 |
| 4,676,829 | 6/1987 | Chang et al. | 75/244 |
| 4,847,044 | 7/1989 | Chosh | 419/10 |
| 4,919,718 | 4/1990 | Tiegs et al. | 75/232 |

OTHER PUBLICATIONS

S. Sridharan et al., "Investigations Within the Quarternary System Titanium-Nickel-Aluminum-Carbon", *Monatshefte fur Chemie,* 114, 127-135 (1983).

A. V. Tumanov et al., "Wetting of TiC-WC System Carbides with Molten $Ni_3Al$", pp. 428-430 of translation from *Poroshkovaya Metallurgiya,* 5(281), pp. 83-86 (May 1986).

*Primary Examiner*—Brooks H. Hunt
*Assistant Examiner*—Leon Nigohosian, Jr.
*Attorney, Agent, or Firm*—Frances P. Craig

[57] ABSTRACT

A dense cermet article including about 80-95% by volume of a granular hard phase and about 5-20% by volume of a metal phase. The granular hard phase consists essentially of a ceramic material selected from the hard refractory carbides, nitrides, carbonitrides, oxycarbides, oxynitrides, carboxynitrides, and borides of titanium, zirconium, hafnium, vanadium, niobium, tantalum, chromium, molybdenum, tungsten, boron, and mixtures thereof. The metal phase consists essentially of a combination of nickel and aluminum having a weight ratio of nickel to aluminum of from about 90:10 to about 70:30 and 0-5% by weight of an additive selected from the group consisting of titanium, zirconium, hafnium, vanadium, niobium, tantalum, chromium, molybdenum, tungsten, cobalt, boron, or carbon, or combinations thereof. In the preferred metal phase, an amount of about 15-80% by volume of the metal phase component exhibits a $Ni_3Al$ ordered crystal structure. The article may be produced by presintering the hard phase - metal phase component mixture in a vacuum or inert atmosphere at about 1475°-1675° C., then densifying by hot isostatic pressing at a temperature of about 1575°-1675° C., in an inert atmosphere, and at about 34-207 MPa pressure. Limiting the presintering temperature to 1475°-1575° C. and keeping the presintering temperature at least 50° C. below the not pressing temperature produces an article of gradated hardness, harder at the surface than at the core.

12 Claims, No Drawings

CERAMIC-METAL ARTICLES AND METHODS OF MANUFACTURE

CROSS REFERENCE TO RELATED APPLICATIONS

This application is a continuation-in-part of commonly assigned, copending U.S. patent application Ser. No. 07/576,241, filed Aug. 31, 1990 and now abandoned. This application contains subject matter related to matter disclosed and claimed in commonly assigned, copending U.S. patent application Ser. Nos. 07/632,237 and 07/635,408, now U.S. Pat. No. 5,041,261 filed concurrently herewith, which are also continuations-in-part of application Ser. No. 07/576,241.

BACKGROUND OF THE INVENTION

This invention relates to metal bonded ceramic, e.g. carbide, nitride, carbonitride, and boride articles for use as cutting tools, wear parts, and the like. In particular the invention relates to such articles bonded with a metal phase including both nickel and aluminum.

The discovery and implementation of cobalt bonded tungsten carbide (WC-Co) as a tool material for cutting metal greatly extended the range of applications beyond that of conventional tool steels. Over the last 50 years process and compositional modifications to WC-Co materials have led to further benefits in wear resistance, yet the potential of these materials is inherently limited by the physical properties of the cobalt binder phase. This becomes evident when cutting speeds are increased to a level which generates sufficient heat to soften the metal binder. The high speed finishing of steel rolls serves as an example of a metal cutting application where the tool insert must maintain its cutting edge geometry at high temperature and resist both wear and deformation.

Unfortunately, the wear characteristics of WC-Co based cemented carbides are also affected by the high temperature chemical interaction at the interface between the ferrous alloy workpiece and the cemented carbide tool surface. Additions of cubic carbides (i.e. TiC) to the WC-Co system have led to some improvement in tool performance during steel machining, due in part to the resulting increased hardness and increased resistance to chemical interaction. However, the performance of such TiC-rich WC-Co alloys is influenced by the low fracture toughness of the TiC phase, which can lead to a tendency toward fracture during machining operations involving intermittent cutting, for example milling.

Accordingly, a ceramic-metal material suitable for cutting tools capable of withstanding the demands of hard steel turning (wear resistance) and steel milling (impact resistance) would be of great value. Such a new and improved material is described herein.

SUMMARY OF THE INVENTION

In one aspect, the present invention is a ceramic-metal article including about 80–95% by volume of a granular hard phase and about 5–20% by volume of a metal phase. The hard phase consists essentially of a ceramic material selected from the hard refractory carbides, nitrides, carbonitrides, oxycarbides, oxynitrides, carboxynitrides, and borides of titanium, zirconium, hafnium, vanadium, niobium, tantalum, chromium, molybdenum, tungsten, boron, and mixtures thereof. The metal phase consists essentially of a combination of nickel and aluminum having a weight ratio of nickel to aluminum of from about 90:10 to about 70:30, preferably about 85:15 to about 88:12, by weight, and 0–5% by weight of an additive selected from the group consisting of titanium, zirconium, hafnium, vanadium, niobium, tantalum, chromium, molybdenum, tungsten, cobalt, boron, or carbon, or combinations thereof. The article has a density of at least about 95% of theoretical.

In a narrower aspect, the article described above has a hardness gradated from a greater hardness at its surface to a lesser hardness at its core.

In other narrower aspects, the metal phase consists essentially of a $Ni_3Al$ ordered crystal structure, or comprises a $Ni_3Al$ ordered crystal structure in an amount of about 15–80% by volume of said metal phase.

DETAILED DESCRIPTION OF THE PREFERRED EMBODIMENTS

For a better understanding of the present invention, together with other objects, advantages and capabilities thereof, reference is made to the following description and appended Claims.

The ceramic-metal materials described herein include one or more hard refractory carbides, nitrides, oxycarbides, oxynitrides, carbonitrides, carboxynitrides, and borides, and mixtures thereof bonded by a metallic phase combining nickel and aluminum. The ceramic materials include compounds of titanium, zirconium, hafnium, vanadium, niobium, tantalum, chromium, molybdenum, tungsten, boron, and mixtures thereof. Typical hard phase components include TiC, HfC, VC, TaC, $Mo_2C$, WC, $B_4C$, TiN, Ti(C,N), $TiB_2$, and WB. Preferred hard phase components include the hard refractory carbides, nitrides, oxycarbides, oxynitrides, carbonitrides, carboxynitrides, and borides of tungsten and titanium.

The following description relates to a preferred densified metal bonded hard ceramic body or article prepared from a tungsten carbide/nickel/aluminum powder mixture; the invention, however, is not limited to these formulations. The powder mixture contains tungsten carbide powder as the hard phase component, and a combination of both Ni powder and Al powder in an amount of about 5–20% by volume as the metal component. The best combination of properties (hardness and fracture toughness) is obtained when total metallic phase addition is in the range of about 7–15% by volume.

In the materials described herein, the tungsten carbide ceramic component provides excellent wear resistance, which is important in applications such as cutting tools for steel turning. The metallic phase provides greater fracture toughness for the material than the sintered ceramic material alone, and the metallic phase combining aluminum and nickel in the above ratios provides improved high temperature properties such as creep resistance over cobalt or other single metal.

As stated above, the metal powder represents about 5–20% by volume and preferably about 7–15% by volume of the total starting formulation. The metal powder includes nickel in an amount of about 70–90%, and preferably about 85–88%, by weight, and aluminum in an amount of about 10–30%, and preferably 12–15%, by weight, both relative to the total weight of the metal powder. A minor amount of titanium, zirconium, hafnium, vanadium, niobium, tantalum, chromium, molybdenum, tungsten, cobalt, boron and/or carbon, not to exceed about 5% by weight of total metal phase components, may also be included. The preferred composition is 12–14% by weight Al, balance Ni. In the most preferred compositions the Ni:Al ratio results in the formation of a $Ni_3Al$ phase, having the $Ni_3Al$ ordered crystal structure. This phase may be present in a minor amount (less than 50% by volume) of the metal phase, or in an amount of about 15–80% by volume of the metal phase components, or some compositions may consist essentially of this phase. In some compositions, this ordered crystal structure may coexist or be modified by the above-mentioned additives. The amount of $Ni_3Al$ in the metal phase is also dependent on the processing, e.g. the processing temperatures. The ratio of Ni:Al required to produce the desired composition of the metal phase, however, may be readily determined empirically for a given set of processing parameters.

The preferred average grain size of the hard phase in a densified body of this material for cutting tool use is about 0.5–5.0 μm. In other articles for applications where deformation resistance requirements are lower, e.g. sand blasting nozzles, a larger range of grain sizes, e.g. about 0.5–20 μm, may prove satisfactory. The material may be densified by known methods, for example sintering, continuous cycle sinter-hip, two step sinter-plus-HIP, or hot pressing, all known in the art.

Another preferred densified, ceramic-metal body or article has the same overall composition as described above, but differs in that it exhibits a gradated hardness, most preferably exhibiting lower hardness in the center portion of the body and progressively increasing hardness toward the tool surface. To obtain a body with these characteristics, the densification process includes a presintering step in which the starting powder mixture is subjected to temperatures of about 1475°–1575° C., preferably 1475°–1550° C., in vacuum (e.g. about 0.1 Torr) or in an inert atmosphere (e.g. at about 1 atm) for a time sufficient to develop a microstructure with closed porosity, e.g. about 0.5–2 hr. As used herein, the term "microstructure with closed porosity" is intended to mean a microstructure in which the remaining pores are no longer interconnected. Subsequently, the body is fully densified in an inert atmospheric overpressure of about 34–207 MPa and temperature of about 1575°–1675° C., preferably 1600°–1675° C., for a time sufficient to achieve full density, e.g. about 0.5–2 hr. The presintering temperature is at least 50° C. lower than the final densification temperature. These gradated bodies exhibit greatly improved fracture toughness when used as steel cutting tools.

The depth to which the gradated hardness is effected is dependent on the presintering temperature. Thus, if a fully gradated hardness is not critical a similar process, but with a broader range of presintering temperatures, about 1475°–1675° C., may be used, and a 50° C. difference between the presintering and hot pressing temperatures is not required.

For certain applications such as cutting tools the articles described herein may be coated with refractory materials to provide certain desired surface characteristics. The preferred coatings have one or more adherent, compositionally distinct layers of refractory metal carbides, nitrides, and/or carbonitrides, e.g. of titanium, tantalum, or hafnium, or oxides, e.g. of aluminum or zirconium, or combinations of these materials as different layers and/or solid solutions. Such coatings may be deposited by methods such as chemical vapor deposition (CVD) or physical vapor deposition (PVD), and preferably to a total thickness of about 0.5–10 μm. CVD or PVD techniques known in the art to be suitable for coating cemented carbides are preferred for coating the articles described herein.

Coatings of alumina, titanium carbide, titanium nitride, titanium carbonitride, hafnium carbide, hafnium nitride, or hafnium carbonitride are typically applied by CVD. The other coatings described above may be applied either by CVD techniques, where such techniques are applicable, or by PVD techniques. Suitable PVD techniques include but are not limited to direct evaporation and sputtering. Alternatively, a refractory metal or precursor material may be deposited on the above-described bodies by chemical or physical deposition techniques and subsequently nitrided and/or carburized to produce a refractory metal carbide, carbonitride, or nitride coating. Useful characteristics of the preferred CVD method are the purity of the deposited coating and the enhanced layer adherency often produced by diffusional interaction between the layer being deposited and the substrate or intermediate adherent coating layer during the early stages of the deposition process.

For certain applications, for example cutting tools, combinations of the various coatings described above may be tailored to enhance the overall performance, the combination selected depending, for cutting tools, on the machining application and the workpiece material. This is achieved, for example, through selection of coating combinations which improve adherence of coating to substrate and coating to coating, as well as through improvement of microstructurally influenced properties of the substrate body. Such properties include hardness, fracture toughness, impact resistance, and chemical inertness of the substrate body.

The following Examples are presented to enable those skilled in the art to more clearly understand and practice the present invention. These Examples should not be considered as a limitation upon the scope of the present invention, but merely as being illustrative and representative thereof.

EXAMPLE 1

Ceramic-metal compacts were prepared from a powder mixture of 10% by volume metal phase (86.7% Ni, 13.3% Al, both by weight, corresponding to a $Ni_3Al$ stoichiometric ratio) and 90% by volume ceramic hard phase.

A charge of 221.28 g of the tungsten carbide and metal powder mixture, 0.0315 g of carbon, 4.13 g of paraffin, and 150 cc of heptane was milled in a 500 cc capacity tungsten carbide attritor mill using 2000 g of 3.2 mm cemented tungsten carbide ball media for 2% hr at 120 rpm. For the compacts including other hard phase components, the milling process was repeated, using a weight of hard phase powder which would produce an equivalent volume percent.

After milling, each batch of powder was separated from the milling media by washing with additional heptane through a stainless steel screen. The excess heptane was slowly evaporated. To prevent binder (wax) inhomogeneity, the thickened slurry was mixed continuously during evaporation, and the caking powder broken up with a plastic spatula into small, dry granules. The dry granules were then sieved in two steps using 40- and 80-mesh screens. Each screened powder was then pressed at 138 MPa, producing green compacts measuring 16×16×6.6 mm and containing 50–60% by volume of solids loading.

The pressed compacts were placed in a graphite boat, covered with alumina sand, and placed in a hydrogen furnace at room temperature. The temperature then was raised in increments of 100° every hour and held at 300° C. for 2 hr to complete the removal of the organic binder. The dewaxed samples were then taken from the hot zone, cooled to room temperature, and removed from the hydrogen furnace.

The dewaxed samples were then densified in two steps: presintering and hot isostatic pressing (HIPing). The dewaxed compacts, on graphite plates which had been sprinkled with coarse alumina sand, were presintered at 1650° C. for 1 hr at about 0.1 Torr in a cold wall graphite vacuum furnace. The initial rise in temperature was rapid, 15° C./min up to 800° C. From 800° C. the rise was reduced to 4.5° C./min. Throughout the entire presintering cycle, the chamber pressure was maintained at about 0.1 Torr.

The final consolidation was carried out in a HIP unit at 1650° C. and 207 MPa of argon for 1 hr, using a heating rate of about 10° C./min. The maximum temperature (1650° C.) and pressure (207 MPa) were reached at the same time and were maintained for about 1 hr, followed by oven cooling to room temperature. The Knoop hardness at the surface of each densified compact is shown in the Table below.

TABLE

| Sample | Powder Composition, v/o | | | | | | | Ave. Surface Hardness*, Knoop, MPa |
|---|---|---|---|---|---|---|---|---|
| | Ni + Al** | WC | TiC | $TiB_2$ | VC | NbC | TaC | |
| 1A | 10 | 90 | — | — | — | — | — | 17.08 |
| 1B | 10 | — | 90 | — | — | — | — | 17.69 |
| 1C | 10 | — | — | 90 | — | — | — | 20.50 |
| 1D | 10 | — | — | — | 90 | — | — | 15.17 |
| 1E | 10 | 1 | 89 | — | — | — | — | 15.43 |
| 1F | 10 | 74.16 | 8.30 | — | — | 4.18 | 3.36 | 14.77 |
| 1G | | | | | | | | 14.5 |
| 1H | | | | | | | | 13.4 |

*1.0N load.
**13.3% by weight Al, balance Ni.
Comparative sample: commercial tool - 10 v/o Ni, 10 v/o Mo, balance TiC.
Comparative sample: commercial tool - 10 v/o Co, 10 v/o Ni, balance MoC/TiC/TiN/VC/WC (proprietary composition).

As shown in the Table, carbide compacts prepared as described above exhibited improved hardness over that of commercially available cutting tools. Titanium and tungsten-titanium carbide compacts prepared as described above exhibited good performance in the dry turning of 1045 steel, 475 ft/min, 0.012 in/rev, 0.050 in D.O.C. (depth of cut).

EXAMPLE 2

Compacts are prepared as described above for Example 1, using the same powders in the starting formulations and the same process, except that the dewaxed compacts are presintered at 1500° C. for 1 hr. at 0.1 Torr in the same cold wall graphite vacuum furnace. The rise in temperature is the same as in Example 1: initially rapid, 15° C./min. up to 800° C. From 800° C., the rise is reduced to 4.5° C./min.

The metal bonded carbide cutting tool of Example 2 is characterized by a specific microstructure in which a gradient of hardness is developed from the surface of the densified article to its core.

The present invention provides novel improved cutting tools capable of withstanding the demands of hard steel turning, which requires a high degree of wear resistance, and steel milling, which requires a high degree of impact resistance. It also provides wear parts and other structural parts of high strength and wear resistance.

While there has been shown and described what are at present considered the preferred embodiments of the invention, it will be obvious to those skilled in the art that various changes and modifications can be made therein without departing from the scope of the invention as defined by the appended Claims.

We claim:

1. A ceramic-metal article comprising:

about 80–95% by volume of a granular hard phase consisting essentially of a ceramic material selected from the group consisting of hard refractory carbides, nitrides, carbonitrides, oxycarbides, oxynitrides, carboxynitrides, and borides of titanium, zirconium, hafnium, vanadium, niobium, tantalum, chromium, molybdenum, tungsten, boron, and mixtures thereof; and about 5–20% by volume of a metal phase, wherein said metal phase consists essentially of a combination of nickel and aluminum having a weight ratio of nickel to aluminum of from about 90:10 to about 70:30 and 0–5% by weight of an additive selected from the group consisting of titanium, zirconium, hafnium, vanadium, niobium, tantalum, chromium, molybdenum, tungsten, cobalt, boron, carbon, and combinations thereof;

wherein said article has a density of at least about 95% of theoretical and has a hardness gradated from a greater hardness at its surface to a lesser hardness at its core.

2. An article in accordance with claim 1 wherein said metal phase comprises about 7–15% by volume of said article.

3. An article in accordance with claim 1 wherein said article is coated with one or more adherent, compositionally distinct layers, each layer being selected from the group consisting of titanium carbide, titanium nitride, titanium carbonitride, tantalum carbide, tantalum nitride, tantalum carbonitride, hafnium carbide, hafnium nitride, hafnium carbonitride, aluminum oxide, zirconium oxide, mixtures thereof and solid solutions thereof.

4. An article in accordance with claim 1 wherein said metal phase consists essentially of a $Ni_3Al$ ordered crystal structure or a $Ni_3Al$ ordered crystal structure coexistent with or modified by said additive.

5. An article in accordance with claim 1 wherein said metal phase comprises a $Ni_3Al$ ordered crystal structure or a $Ni_3Al$ ordered crystal structure coexistent with or modified by said additive, present in an amount of about 15–80% by volume of said metal phase.

6. An article in accordance with claim 5 wherein said metal phase comprises a $Ni_3Al$ ordered crystal structure or a $Ni_3Al$ ordered crystal structure coexistent with or modified by said additive, in an amount of less than about 50% by volume of said metal phase.

7. An article in accordance with claim 1 wherein said hard phase has an average grain size of about 0.5–20 μm.

8. An article in accordance with claim 7 wherein said hard phase has an average grain size of about 0.5–5.0 μm, and said article is of a geometry suitable for use as a cutting tool.

9. An article in accordance with claim 8 wherein said article is coated with one or more adherent, compositionally distinct layers, each layer being selected from the group consisting of titanium carbide, titanium nitride, titanium carbonitride, tantalum carbide, tantalum nitride, tantalum carbonitride, hafnium carbide, hafnium nitride, hafnium carbonitride, aluminum oxide, zirconium oxide, mixtures thereof and solid solutions thereof.

10. An article in accordance with claim 7 wherein said hard phase has an average grain size of about 5–20 μm.

11. A ceramic-metal article comprising:

about 80–95% by volume of a granular hard phase consisting essentially of a ceramic material selected from the hard refractory carbides, nitrides, carbonitrides, oxycarbides, oxynitrides, carboxynitrides, and borides of titanium, zirconium, hafnium, vanadium, niobium, tantalum, chromium, molybdenum, tungsten, boron, and mixtures thereof; and about 5–20% by volume of a metal phase, wherein said metal phase consists essentially of a combination of nickel and aluminum having a weight ratio of nickel to aluminum of from about 90:10 to about 70:30 and 0–5% by weight of an additive selected from the group consisting of titanium, zirconium, hafnium, vanadium, niobium, tantalum, chromium, molybdenum, tungsten, cobalt, boron, carbon, and combinations thereof, wherein said metal phase comprises a $Ni_3Al$ ordered crystal structure or a $Ni_3Al$ ordered crystal structure coexistent with or modified by said additive, in an amount of about 15–80% by volume of said metal phase;

wherein said article has a density of at least about 95% of theoretical and has a hardness gradated from a greater hardness at its surface to a lesser hardness at its core.

12. An article in accordance with claim 11 wherein said metal phase comprises a $Ni_3Al$ ordered crystal structure or a $Ni_3Al$ ordered crystal structure coexistent with or modified by said additive, in an amount of less than about 50% by volume of said metal phase.

* * * * *